US005551225A

United States Patent [19]

Maruki et al.

[11] Patent Number: 5,551,225

[45] Date of Patent: Sep. 3, 1996

[54] APPARATUS FOR SUPPRESSING FLUFF IN SPUN YARN

[75] Inventors: Hiroshige Maruki, Kusatsu; Tsutomu Mekata, Ohtsu, both of Japan

[73] Assignee: Murata Kikai Kabushiki Kaisha, Kyoto, Japan

[21] Appl. No.: 285,725

[22] Filed: Aug. 4, 1994

[30] Foreign Application Priority Data

Aug. 6, 1993 [JP] Japan ..... 5-215162

[51] Int. Cl.[6] ..... D01H 5/00; D01H 5/28

[52] U.S. Cl. ..... 57/328; 57/5; 57/315; 57/333; 57/335; 57/350; 57/351

[58] Field of Search ..... 57/315, 318, 328, 57/330, 331, 332, 333, 334, 335, 336, 284, 350, 5, 337, 351; 242/157 R, 149, 150 R, 151; 792/27, 59; 226/190

[56] References Cited

U.S. PATENT DOCUMENTS

| | | | |
|---|---|---|---|
| 4,434 | 2/1848 | Pratt | 492/27 |
| 331,328 | 12/1885 | Randall | 492/27 |
| 2,943,433 | 7/1960 | Van Dijk | 57/335 |
| 3,842,582 | 10/1974 | Richter | 57/336 |
| 4,047,373 | 9/1977 | Takai | 57/336 |
| 4,400,931 | 8/1983 | Maeda | 57/336 |
| 4,524,580 | 6/1985 | Fehrer | 57/328 X |
| 4,823,545 | 4/1989 | Flueckiger | 57/328 |
| 5,094,068 | 3/1992 | Mirao | 57/336 X |
| 5,243,813 | 9/1993 | Stahlecker | 57/315 X |

FOREIGN PATENT DOCUMENTS

| | | | |
|---|---|---|---|
| 2667618 | 4/1992 | European Pat. Off. | 57/328 |
| 27851 | 3/1977 | Japan | 57/336 |
| 1061515 | 3/1989 | Japan | 57/328 |
| 3161535 | 7/1991 | Japan | 57/336 |
| 4-5302220 | 11/1993 | Japan | 57/328 |

*Primary Examiner*—William Stryjewski

*Attorney, Agent, or Firm*—Armstrong, Westerman, Hattori, McLeland & Naughton

[57] ABSTRACT

A fluff suppression apparatus comprising a pair of rollers disposed with axes of rotation thereof crossed with each other and in contact with each other for nipping a spun yarn thread, and at least one of the pair of rollers has, at a contacting portion thereof with the spun yarn thread, has resiliency and flexibility and has a cavity formed in the inside thereof.

13 Claims, 5 Drawing Sheets

APPARATUS FOR SUPPRESSING FLUFF IN SPUN YARN

BACKGROUND OF THE INVENTION

1. Field of the Invention

This invention relates to a fluff suppression apparatus which is a working apparatus for a spun yarn.

2. Description of the Related Art

Conventionally, in a pneumatic spinning machine, a sliver supplied from a can is first drafted by a drafting apparatus, which is formed from three or more pairs of draft rollers, and is then passed through a pneumatic spinning nozzle, in which whirling air flows by jetting of compressed air are produced, to temporarily twist and spin the same to produce a spun yarn which is in a twisted condition as twined fibers are present on the surface layer of parallel core fibers. On the surface of such a spun yarn, extremities of part of the twined fibers are separated to form a significant amount of fluff, which makes the spun yarn a cloudy yarn, having a significant influence on the quality of the spun yarn.

Thus, a fluff suppression apparatus wherein a spun yarn is nipped between and sent out by a lower roller and a nipping member such as a nip belt or a nip roller for contacting with the lower roller has been developed in order to decrease fluff of a spun yarn. Such a fluff suppression apparatus, however, has a problem in that the lower roller is liable to be locally abraded at a location thereof at which a yarn is nipped and besides an operation for maintenance such as adjustment of the contacting pressure is not easy.

SUMMARY OF THE INVENTION

It is an object of the present invention to provide, in view of such points of the prior art as described above, a fluff suppression apparatus which can produce a spun yarn substantially free from fluff and is superior in durability and easy to perform maintenance such as adjustment of the contacting pressure.

A fluff suppression apparatus of the present invention is constructed such that it comprises a pair of rollers disposed with axes of rotation thereof crossed with each other and in contact with each other for nipping and sending out a yarn, and at least one of the pair of rollers has, at a contacting portion thereof with the yarn, resiliency and flexibility and has a cavity formed in the inside thereof.

One of the pair of rollers which has resiliency and flexibility is deformed, at the contacting portion thereof with the other roller, along the shape of the circumference of the other roller so that it has face contact with the other roller. And, when a spun yarn is nipped between the other roller and the one roller which contacts in face contact with the other roller and has a running direction crossing with that of the other roller, a false twisting action and a rubbing action are applied to the spun yarn, and consequently, fluff on the surface of the yarn is twined around the yarn itself and suppressed.

The contacting pressure, that is, the contacting depth of the one roller having resiliency and flexibility with the other roller is held fixed as an allowable range is produced to some degree by deformation of the one roller upon pressure contact, and adjustment of the contacting pressure is easy. Further, since the rollers contact in face contact with each other and also the contacting pressure distribution in the contacting plane is comparatively uniform, a yarn can be traversed within the contacting plane, and in this instance, local abrasion of the rollers is prevented.

DETAILED DESCRIPTION OF PREFERRED EMBODIMENT

An embodiment will be described with reference to the drawings.

Figure 1:
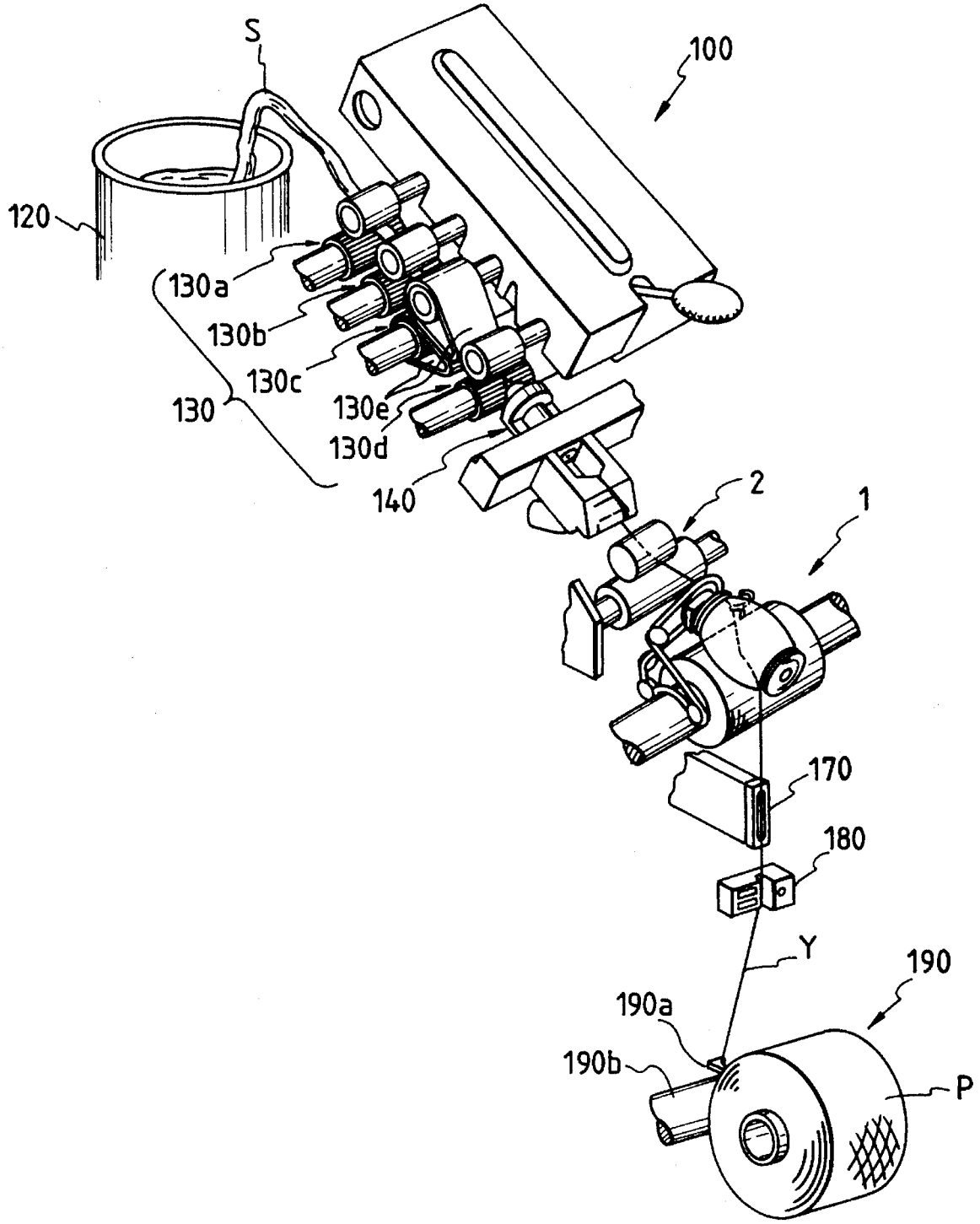
FIG. 1 is a perspective view showing a spinning apparatus which employs a fluff suppression apparatus of a preferred exemplary embodiment of the present invention.

A spinning apparatus 100 which employs a fluff suppression apparatus 1 of the present invention is shown in FIG. 1. Referring to FIG. 1, the spinning apparatus 100 includes a drafting apparatus 130 of the four lines type including a back roller pair 130*a*, a third roller pair 130*b*, a second roller pair 130*c* on which a pair of apron belts 130*e* are mounted, and a front roller pair 130*d*, a pneumatic spinning apparatus 140 wherein two pneumatic spinning nozzles of a first nozzle and a second nozzle in each of which a pair of compressed air jetting nozzles for producing whirling air flows in the opposite directions to each other are opened to the inside are arranged in series, a delivery roller 2, the fluff suppression apparatus 1, a slack tube 170, a yarn clearer 180 having a yarn defect detection function and a fluff amount measurement function, and a take-up apparatus 190, all arranged in order from the upstream side to the downstream side. The spinning apparatus 100 is constructed such that a sliver S supplied from a can 120 is first drafted by the drafting apparatus 130 and then twisted by false twisting by the pneumatic spinning apparatus 140 to spin a spun yarn and then the spun yarn delivered from the delivery roller 2 is passed through the fluff suppression apparatus 1 to make a spun yarn Y whose fluff is suppressed, whereafter the spun yarn Y is taken up onto a package P by the take-up apparatus 190 in which it is traversed by a traverse guide 190*a* while a friction roller 190*b* which rotates positively is contacted under pressure with the package P. A unit is made up of the spinning apparatus 100 as shown in FIG. 1 and a single spinning frame is constituted of a plurality of the units which are arranged in parallel.

Figure 2:
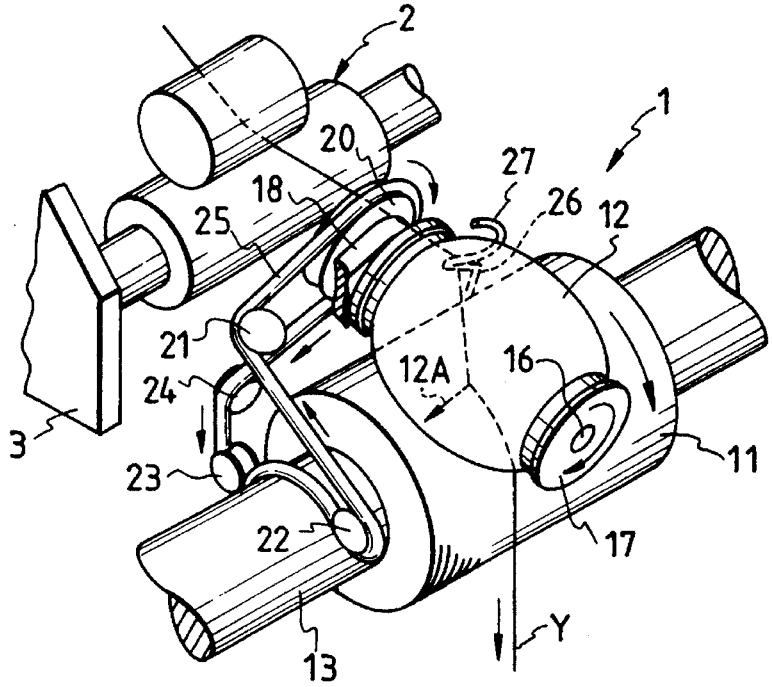
FIG. 2 is a perspective view, partly in section, showing the fluff suppression apparatus of the preferred exemplary embodiment of the present invention.
Figure 3:
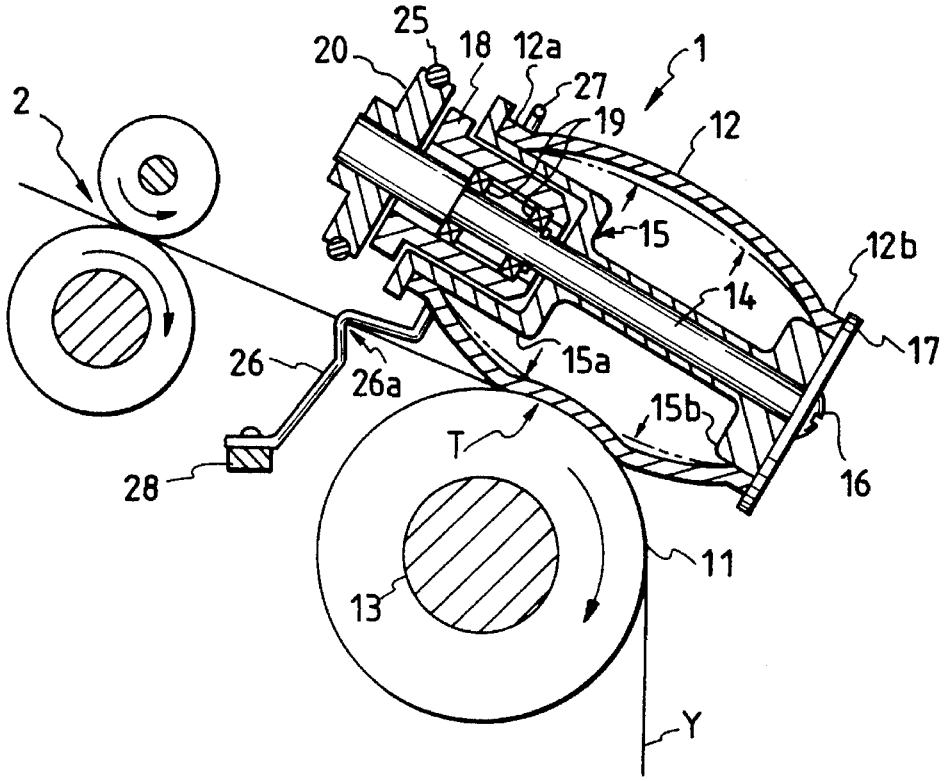
FIG. 3 is a side elevational sectional view showing the fluff suppression apparatus of the preferred exemplary embodiment of the present invention.
Figure 4:
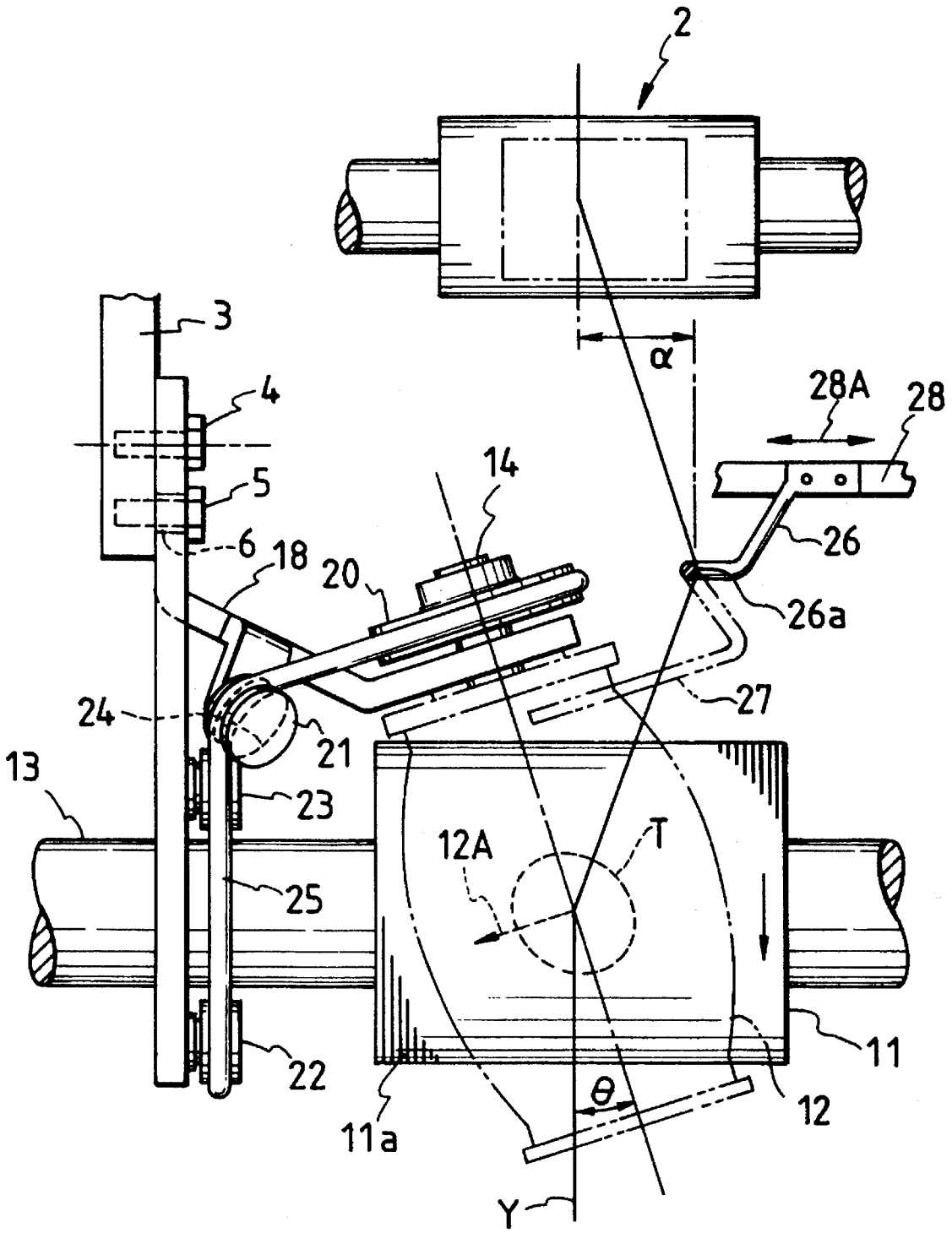
FIG. 4 is a plan view showing the fluff suppression apparatus of the preferred exemplary embodiment of the present invention.

Referring to FIGS. 2 to 4, the fluff suppression apparatus 1 of the present embodiment is principally includes a lower roller 11 and an upper roller 12 having an axis of rotation crossing with that of the lower roller 11 and contacting with the lower roller 11 such that a yarn is nipped between and sent out by them. In the embodiment shown, the fluff suppression apparatus 1 is provided on the downstream side of the delivery roller 2 of the spinning machine.

The lower roller 11 is in the form of a metal roller processed for increasing the coefficient of friction such as forming, on the surface thereof, as shown in FIG. 4, lines (threads) 11*a* of the pitch of approximately 0.3 mm and the depth of approximately 0.5 mm in a direction perpendicular to the axial line by thread cutting or a like operation, and such lower rollers 11 are secured to a drive shaft 13 which is provided to extend across a large number of spindles arranged in a juxtaposed relationship in the spinning machine so that they are all driven together. As such processing for increasing the coefficient of friction, blast processing or like processing may be applied to the surface of the metal. Meanwhile, the lower roller 11 may be in the form of a rubber roller, but from the point of view of durability, it is preferably in the form of a metal roller.

The upper roller 12 is a hollow and cylindrical rubber roller of a thin material as shown in FIG. 3 and is processed by crowning so that a central portion thereof has a larger diameter than the opposite end portions 12*a* and 12*b* thereof. And, the upper roller 12 is supported on a roller core member 15 while prevented from being pulled off from the roller core member 15 by fitting the opposite end portions 12*a* and 12*b* thereof onto the opposite end flange portions 15*a* and 15*b* of the roller core body 15 fitted on a rotary shaft 14 and then securing a disk 17 to an end of the rotary shaft 14 by means of a screw 16. It is to be noted that the interior cavity is not completely closed up, and accordingly, if the roller 12 is pressurized from the outside, then it is readily depressed. That is , an atmospheric pressure in the inside of the cavity is maintained under general atmosphere. Furthermore, the cavity within the roller 12 is continuous to the outside of the roller 12, so that the heat stored within the cavity of the roller can be dispersed to the atmosphere.

The rotary shaft 14 is supported for rotation by means of a bearing 19 at one of a pair of ends of a bifurcated bracket 18 secured to a machine frame 3 by means of a pair of bolts 4 and 5, and is disposed obliquely at an angle θ (for example, 15°) within a horizontal plane with respect to a yarn delivering direction. And, a pulley 20 is secured to the other end of the rotary shaft 14. A round belt 25 extends between the pulley 20 and four pulleys 21, 22, 23 and 24 supported for individual rotation on the bracket 18, and the round belt 25 is contacted, on an outer periphery side thereof between the pulley 22 and the pulley 23, under pressure with the drive shaft 13 for the lower roller 11.

Meanwhile, a threaded hole 6 for one 5 of the bolts 4 and 5 for securing the bracket 18 to the machine frame 3 is in the form of an arcuate elongated hole centered at a threaded hole for the other bolt 4 so that the mounting angle of the bracket 18 can be varied in a vertical direction with respect to the bolt 4. The mounting angle is set so that the contacting pressure of the round belt 25 with the drive shaft 13 may be an appropriate value, and the bracket 18 is secured at the position.

A yarn guide member 26 is provided on the yarn introduction side of the fluff suppression apparatus 1. The yarn guide member 26 is formed from a wire material which is bent so as to provide a yarn guide portion 26*a* substantially at a central portion thereof, and the yarn guide portion 26*a* supports a spun yarn Y in the rightward direction in FIGS. 2 and 4 thereon to prevent the spun yarn Y from being fed in a driving direction 12*a* of the upper roller 12 and guides the spun yarn Y to a contacting plane T between the lower roller 11 and the upper roller 12 which will be hereinafter described. Meanwhile, a terminal end side of the yarn guide member 26 with respect to the yarn guide portion 26*a* is formed in an arc along the circumference of the upper roller 12 to form a yarn introduction guide member 27, and when the spun yarn Y is to be introduced into the fluff suppression apparatus 1, the spun yarn Y is guided by the yarn introduction guide member 27 so that it can be introduced into the contacting plane T between the upper roller 12 and the lower roller 11. The yarn guide member 26 is secured at a base portion thereof to a traverse member 28, which is moved back and forth in the direction of an arrow mark 28A in FIG. 4 by a power source (not shown).

The operation of the preferred exemplary embodiment will be described below.

Rotation of the drive shaft 13 for the lower roller 11 is transmitted to the rotary shaft 14 for the upper roller 12 by way of the round belt 25 and the pulley 20 so that the upper roller 12 is driven in the direction of the arrow mark 12A in the contacting plane T at a fixed speed ratio to the lower roller 11. Since the upper roller 12 has a larger diameter at the central portion than the opposite end portions 12*a* and 12*b* thereof and the surface of the roller 12 has an arch-like shape convex toward the outside from the axis of the roller 12 as described hereinabove, the roller 12 yields so-called "resiliency" so that a strong contacting pressure can be obtained when the lower roller 11 is contacted under pressure with the upper roller 12. Consequently, the hollow upper roller 12 made of rubber and having a small material thickness is further swollen by a centrifugal force acting upon the upper roller 12 so that, at the contacting portion thereof with the lower roller 11, it is pressed further strongly against the circumference of the lower roller 11 and besides it is deformed along the profile of the lower roller 11 as shown in FIG. 3, and as a result, the contacting plane T provides face contact over a comparatively wide area as shown in FIG. 4.

Consequently, since an allowable range to some degree is produced in the depth of contact of the upper roller 12 with the lower roller 11, adjustment of the contacting pressure is easy, and it is possible, as in the present embodiment, to support the pulleys 22 and 23 and the upper roller 12, on which the round belt 25 for driving transmission is supported, by means of the common bracket 18 and perform mounting of the bracket 18 placing the precedence on setting of the contacting pressure of the round belt 25 with the drive shaft 13.

The spun yarn Y spun by the spinning apparatus (not shown) and delivered from the delivery roller 2 is guided by the yarn guide member 26 and sent into the contacting plane T, and then when it is nipped between and sent out by the lower roller 11 and the upper roller 12, which contacts with the lower roller 11 with its feeding direction crossing with that of the lower roller 11, a false twisting action and a rubbing action are applied to the spun yarn Y. Consequently, fluff on the surface of the spun yarn Y is pressed to the yarn itself and suppressed.

Meanwhile, since the lower roller 11 and the upper roller 12 are in face contact with each other over a comparatively wide area as described above, the spun yarn Y can be traversed within the contacting plane T by moving the yarn guide member 26 back and forth by means of the traverse member 28. Consequently, also where a rubber roller is employed for the lower roller 11, local abrasion at the nipping portion of the lower roller 11 can be prevented and the durability of the lower roller 11 can be enhanced.

A yarn can be easily introduced between the lower roller 11 and the upper roller 12 since the rollers 11 and 12 are contacted with each other at the curved surfaces thereof. Furthermore, the contacting pressure between the rollers 11 and 12 may be maintained to be constant being regardless of mechanical vibration because the contacting area of the rollers with a yarn is constituted by using soft resilient material, that is, the hollow roller 12 made of rubber. To accomplish an appropriate soft resilient condition, it is prefer to use the hollow roller 12 made of rubber having a thickness (thickness at an central portion of a roller) ranging from 1 to 2.5 mm, preferably 1.6 to 2.0 mm.

In the following, the degree of suppression of fluff will be described based on concrete experimental data.

Figure 5:
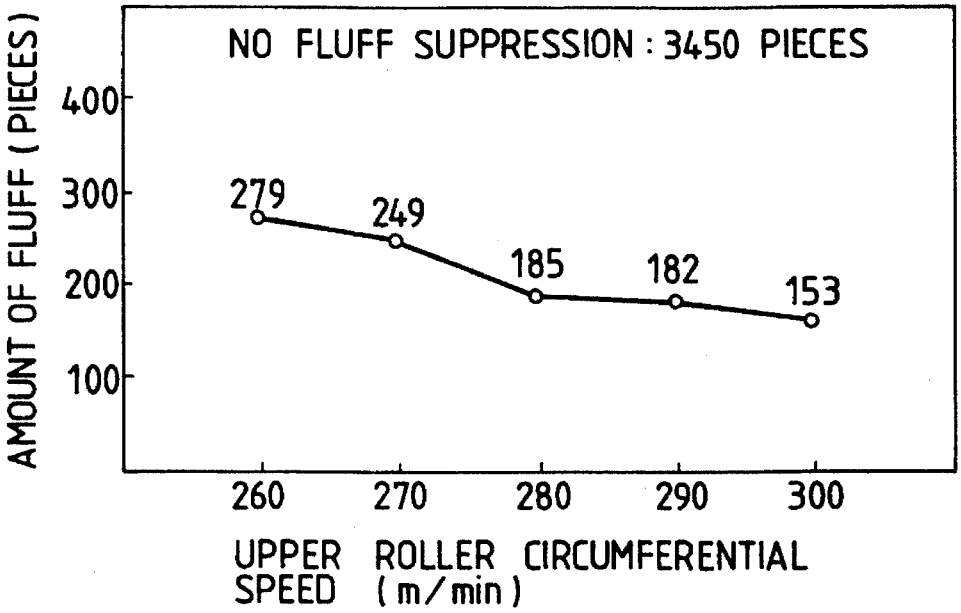
FIG. 5 is a graph illustrating the relationship between the circumferential speed of an upper roller and the amount of fluff.
Figure 6:
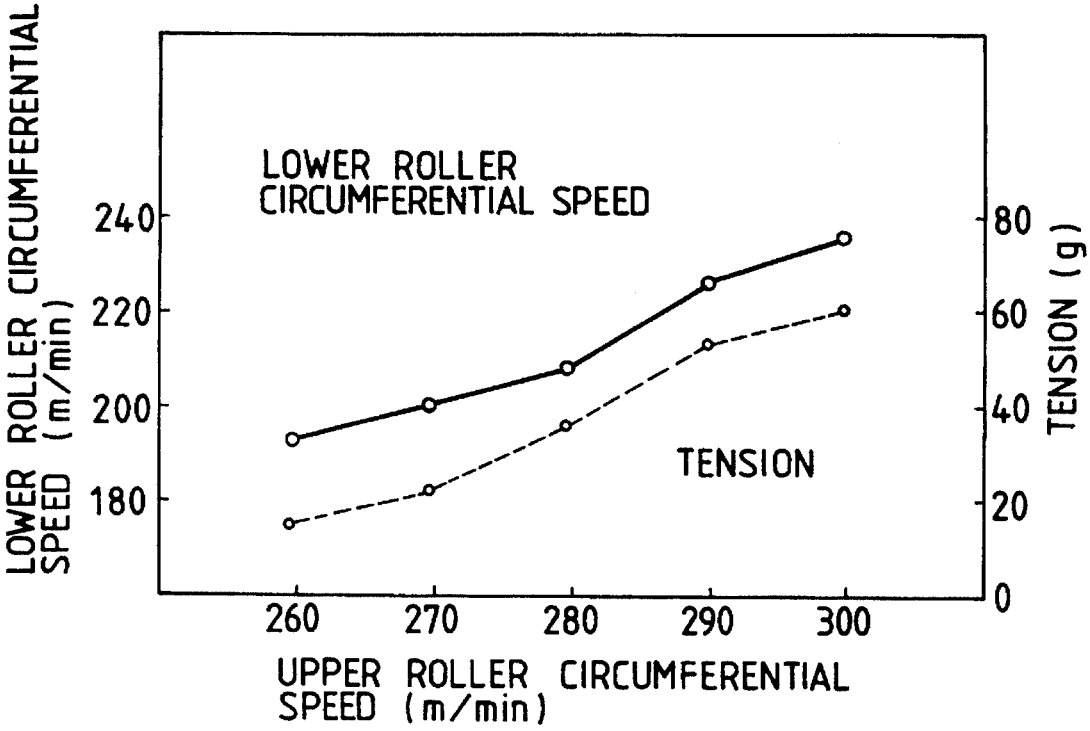
FIG. 6 is a graph illustrating the relationship among the circumferential speed of the upper roller, the circumferential speed of a lower roller and the tension of a yarn.

FIG. 5 is a graph illustrating the relationship between the circumferential speed of the upper roller and the amount of fluff when a blended yarn of yarn number count 30 made of polyester of 65% and cotton of 35% was spun under the spinning conditions of the spinning speed of 212 m/min and the feed rate of 0.97 and, in the fluff suppression apparatus 1 shown in FIGS. 2 to 4, the hollow upper roller made of rubber and having the thickness of 2 mm was contacted under pressure with the contacting depth of about 1 mm with the lower roller made of sintered stainless steel and having longitudinal lines at the pitch of 0.4 mm to apply fluff suppression to the blended yarn. The amount of fluff is a total number of fluff pieces observed at the position spaced by 0.5 mm from the center of the yarn per 10 m in length of the spun yarn. Meanwhile, FIG. 6 is a graph illustrating the relationship among the circumferential speed of the upper roller, the circumferential speed of the lower roller upon the measurement of the amount of fluff described above and the tension of the spun yarn upon introduction of the yarn into the fluff suppression apparatus 1, and the circumferential speed ratio between the circumferential speed of the upper roller and the circumferential speed of the lower roller is kept fixed at about 1:1.3.

From FIG. 5, it can be seen that the amount of fluff of the spun yarn to which fluff suppression was applied by the fluff suppression apparatus 1 is reduced to substantially 4 to 8% of the number of fluff pieces of 3,450 of another spun yarn which was spun in the same conditions but was not processed by fluff suppression, and the spun yarn is substantially in a fluff-free condition and the fluff exhibits a tendency that it further decreases as the circumferential speed of the upper roller increases.

Figure 7:
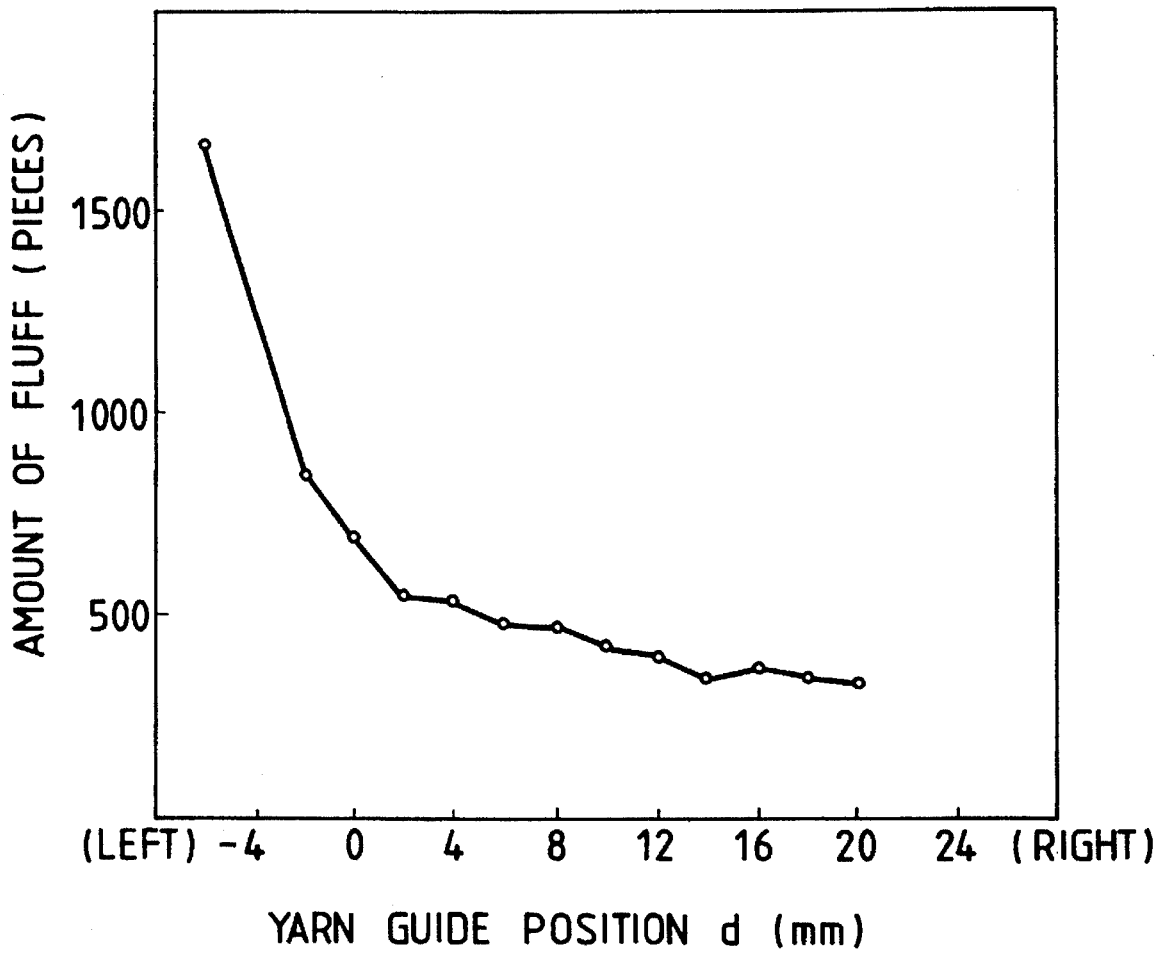
FIG. 7 is a graph illustrating the relationship between the position of a yarn guide and the amount of fluff.

Meanwhile, FIG. 7 is a graph illustrating the relationship between the yarn guide position d and the amount of fluff in the fluff suppression apparatus 1 wherein the circumferential speed of the lower roller was set to 15 m/min and the circumferential speed of the upper roller was set to 288 m/min (circumferential speed ratio 1:1.92) for a similar spun yarn spun at the spinning speed of 150 m/min. The yarn guide position d is the amount of displacement of the yarn guide portion 26*a* of the yarn guide member 26 from a yarn delivering line 2*c* of the delivery roller 2 shown in FIG. 4, and is positive in the rightward direction in FIG. 4.

FIG. 7 indicates that, while the quantity of fluff has a tendency to decrease a little as the yarn guide position d is displaced to the right side and the nipping point in the contacting plane T shown in FIG. 4 moves to the right, when the yarn guide position d is within the range of 3 to 20 mm, the fluff suppression condition is substantially fixed, and it is possible to traverse the yarn within that range.

While, in the preferred exemplary embodiment described above, a solid roller is employed as the lower roller, a hollow rubber roller similar to the upper roller may be employed, or a roller formed in a balloon shape may be used for the hollow roller and have compressed air enclosed therein to obtain a certain contacting pressure. Further, a porous resilient member such as sponge may be employed in place of a rubber roller.

The present invention can be applied to spinning machines including a pneumatic spinning machine and various textile machines such as a winder for which fluff suppression is effective. Further, a soft resilient member in the present invention denotes a member having resiliency and flexibility such as, for example, a rubber member of a small material thickness or sponge.

Since a fluff suppression apparatus of the present invention is constructed such that it comprises a pair of rollers disposed with axes of rotation thereof crossed with each other and in contact with each other for nipping and sending out a yarn, and at least one of the pair of rollers, at a contacting portion thereof with the yarn, has resiliency and flexibility and has a cavity formed in the inside thereof as described above, the two rollers are in face contact and a yarn is nipped with certainty so that a spun yarn substantially free from fluff can be obtained. Since adjustment of the contacting pressure is easy, the structure for driving transmission can be simplified. Further, since face contact is involved, a traverse system can be adopted, and consequently, local abrasion of the rollers can prevented and the durability of the apparatus can be enhanced.

What is claimed is:

1. A fluff suppression apparatus comprising:

a pair of first and second rotary members disposed with respective axes of rotation thereof crossed at an angle with each other and in contact with each other for nipping a spun thread yarn, wherein at least said first rotary member has, at a contacting portion thereof with the yarn, soft resiliency and wherein a central portion of said first rotary member has a diameter greater than the opposite end portions thereof.

2. A fluff suppression apparatus as claimed in claim 1, wherein said first rotary member is formed at the surface thereof from a soft resilient member, and a cavity is formed in the inside of the member.

3. A fluff suppression apparatus as claimed in claim 2, wherein said first rotary member is a rubber roller.

4. A fluff suppression apparatus as claimed in claim 3, wherein both first and second rotary members are hollow rollers made of rubber.

5. A fluff suppression apparatus as claimed in claim 1, wherein said first rotary member is a porous resilient material.

6. A fluff suppression apparatus as claimed in claim 1, wherein said first rotary member is a roller having soft resiliency, and the second rotary member is a roller made of metal.

7. A fluff suppression apparatus as claimed in claim 6, wherein the surface of the roller made of metal has an increased coefficient of friction thereof.

8. A fluff suppression apparatus as claimed in claim 1, wherein said pair of first and second rotary members are disposed with the respective axes of rotation thereof crossed substantially perpendicularly with each other.

9. A fluff suppression apparatus as claimed in claim 1, wherein said central portion of said first rotary member contacts with said second rotary member.

10. A fluff suppression apparatus as claimed in claim 1, further comprising a yarn guide member located upstream of said pair of rotary members for controlling the path of the yarn.

11. A fluff suppression apparatus as claimed in claim 10, wherein said yarn guide member moves back and forth in parallel to the axis of said second rotary member to traverse the yarn.

12. A fluff suppression apparatus as claimed in claim 1, wherein said fluff suppression apparatus is disposed on the downstream side of a delivery roller of a spinning apparatus in which a drafting apparatus, a pneumatic spinning nozzle, said delivery roller and a take-up apparatus are installed, and applies twisting and rubbing to a spun yarn having passed said delivery roller to reform the spun yarn.

13. A fluff suppression apparatus as claimed in claim 1, wherein said pair of first and second rotary members contact each other at curved surfaces thereof, respectively.

* * * * *